United States Patent [19]

Cooper

[11] Patent Number: 4,608,012

[45] Date of Patent: Aug. 26, 1986

[54] GAS BURNER

[75] Inventor: Charles F. Cooper, Malvern, England

[73] Assignee: Morgan Thermic Limited, Worcestershire, England

[21] Appl. No.: 629,727

[22] PCT Filed: Nov. 8, 1983

[86] PCT No.: PCT/GB83/00282

§ 371 Date: Jul. 3, 1984

§ 102(e) Date: Jul. 3, 1984

[87] PCT Pub. No.: WO84/01992

PCT Pub. Date: May 24, 1984

[30] Foreign Application Priority Data

Nov. 11, 1982 [GB] United Kingdom ..... 8232281

[51] Int. Cl.[4] ..... F23D 14/12

[52] U.S. Cl. ..... 431/328

[58] Field of Search ..... 431/328, 354; 126/92 AL

[56] References Cited

U.S. PATENT DOCUMENTS

| | | | |
|---|---|---|---|
| 3,199,571 | 8/1965 | Koppel | 431/328 |
| 3,208,247 | 9/1965 | Weil et al. | 431/328 |
| 3,367,149 | 2/1968 | Manske . | |
| 3,425,675 | 2/1969 | Twine | 431/328 X |
| 3,561,902 | 2/1971 | Best | 431/328 |
| 3,954,387 | 5/1976 | Cooper . | |
| 4,413,976 | 11/1983 | Scherer | 431/328 X |
| 4,439,136 | 3/1984 | Pfefferle | 431/328 X |

FOREIGN PATENT DOCUMENTS

| | | |
|---|---|---|
| 1303596 | 5/1972 | Fed. Rep. of Germany . |
| 2834892 | 2/1979 | Fed. Rep. of Germany . |
| 1577719 | 8/1969 | France . |
| 1082823 | 9/1967 | United Kingdom . |
| 1100156 | 1/1968 | United Kingdom . |
| 1105197 | 3/1968 | United Kingdom . |
| 1133292 | 11/1968 | United Kingdom . |
| 1419763 | 12/1975 | United Kingdom . |
| 1439767 | 6/1976 | United Kingdom . |

*Primary Examiner*—Randall L. Green

*Attorney, Agent, or Firm*—William R. Hinds

[57] ABSTRACT

A self-aerating radiant gas burner assembly comprises a mixing chamber (1) closed except for an air inlet (3) into which is directed a gas injector jet (4), of 0.5 to 2.0 mm bore, to induce flow of air through the inlet, the chamber being surmounted by a radiant burner element of ceramic foam material of a porosity between 15 and 40 pores per linear 25 mm and a thickness between 8 and 30 mm, the dimensions within these ranges being selected for a specified gas and pressure range with the relationship that the lower the gas pressure the larger the jet size.

4 Claims, 4 Drawing Figures

GAS BURNER

Figure 1:
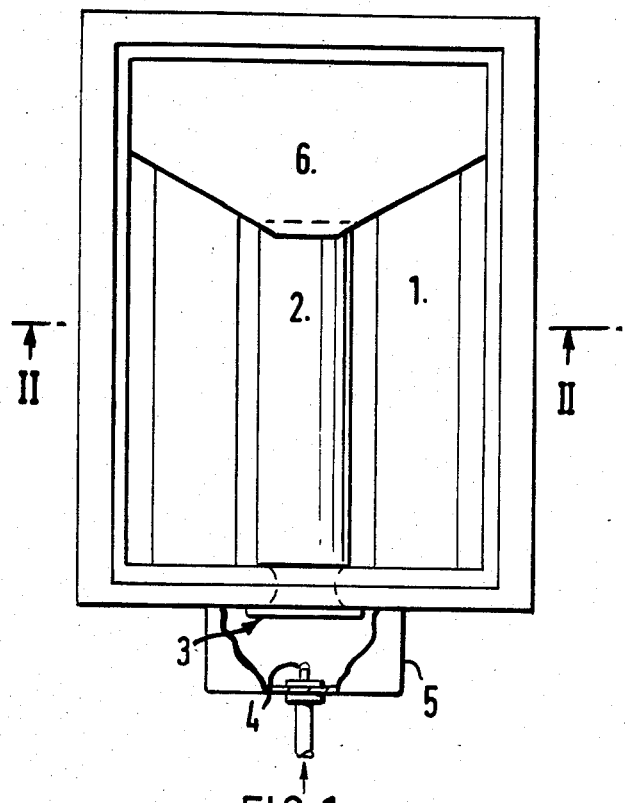

This invention relates to gas burners utilising a heat radiant burner element made of finely porous ceramic material, known as ceramic foam, through the pores of which a combustible mixture of gas and air, or oxygen, is passed to emerge and burn at a surface of the element.

Ceramic foam is made by impregnating a precursor matrix of a reticulated polyurethane foam, or like combustible foam material, with an aqueous ceramic slip or slurry, drying and firing the impregnated material so as to burn out the combustible matrix and leave a porous ceramic structure corresponding to a lining or coating of the cellular structure of the original polyurethane or other matrix. By selection of the precursor foam matrix and ceramic impregnant, the porosity of the ceramic foam can be determined and graded in terms of the number of pores per linear unit, for example pores per linear 25 mm or per linear inch.

Gas does not pass easily through the small pores of ceramic foam and previous proposals to use such material for radiant gas burner elements have involved special structures, for example of relatively coarse and fine porous layers, or the use of air or gas and air mixture under applied pressure instead of ordinary supply pressure.

The present invention provides a self-aerating gas burner utilising simply ceramic foam material as a radiant burner element, mounted on a box base, and only the supply pressure of gas, mains or bottled, injected through a gas jet to induce flow of air into the box base to mix with the gas and pass through the burner element.

According to the invention, a self-aerating radiant gas burner assembly comprises a box base mixing chamber having an air inlet into which is directed a gas injector jet to induce flow of air through the inlet, the chamber being surmounted by a radiant burner element of ceramic foam material, the bore diameter of the gas injector jet being between 0.5 and 2.0 mm inclusive, the nominal porosity of the ceramic foam material being between 15 and 40 pores per linear 25 mm inclusive, the thickness of the burner foam material being between 8 and 30 mm inclusive and the dimensions within these ranges being selected for a specified gas and pressure range with the relationship that the lower the gas pressure the larger the jet size.

The polyurethane or like precursor matrix foams, by the use of which are made the ceramic foam materials used in the burners of the present invention, are supplied by the manufacturers with a nominal porosity stated in pores per linear unit. In practice, it has been found that there is a variable tolerance factor which may be as much as ±5 pores per linear 25 mm. This is due to the inexact nature of the precursor foam which is, of course, carried through to the resulting ceramic foam material. It must therefore be understood that the porosity values given in this specification are nominal values subject to manufacturing tolerances.

The porosity of the ceramic foam material used in the gas burners of the present invention is the most critical feature for satisfactory performance. When ceramic foam materials of a porosity of 10 pores per linear 25 mm are used, it is not possible to get the required combination of stable combustion with acceptable radiant output because it has been found that the burner lights back, that is to say the flame front travels back from the outer face of the burner element to the inner surface towards the burner base. When ceramic foam materials of a porosity of 45 pores per linear 25 mm are used, the pore size is too small to pass a sufficient quantity of gas/air mixture to provide stable combustion and there is excessive back pressure in the mixing chamber, preventing sufficient air from being induced to provide the correct proportion for stable combustion.

Whilst we have found that ceramic foam materials with porosities in the range 15 to 40 pores per linear 25 mm can be used to manufacture satisfactory self-aerating gas burners, the best results have been obtained with a porosity of about 30 pores per linear 25 mm.

The thickness of the ceramic foam material of the burner elements is not critical insofar that radiant output does not vary to any great extent as a function of thickness of the material for a given porosity. However, it has been found that burner elements of a thickness less than 8 mm have a tendency to light back. This is believed to be due to the relatively high thermal conductivity of the ceramic material and therefore high heat transfer back through the elements. In general there is no benefit in using a burner element thickness greater than 30 mm. With burner elements of higher thickness than 30 mm, back pressure increases and this can lead to unstable combustion conditions. Accordingly burner element thicknesses in the range 8 to 30 mm are preferred.

The selection of gas injector jet sizes, within the specified range of 0.5 to 2.0 mm bore diameter should be carried out according to criteria, such as of gas consumption and heat output, well known in the art. The size selected will also depend upon the gas supply pressure and the type of gas used, examples of which are butane, propane, natural gas and town gas, i.e. gas manufactured from coal or other fuel.

Figure 3:
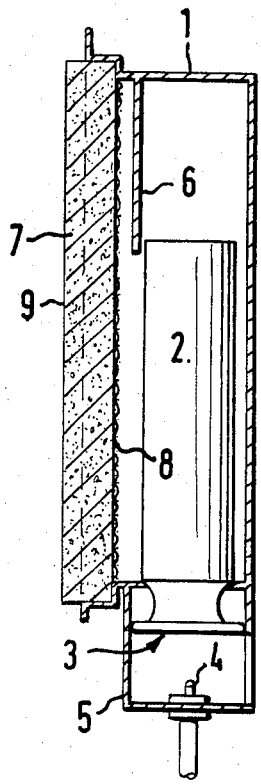
Figure 2:
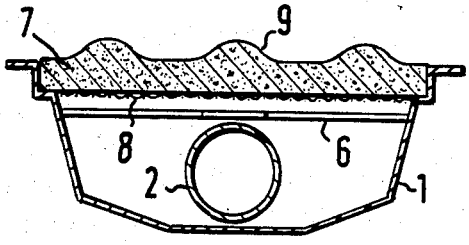
Figure 4:
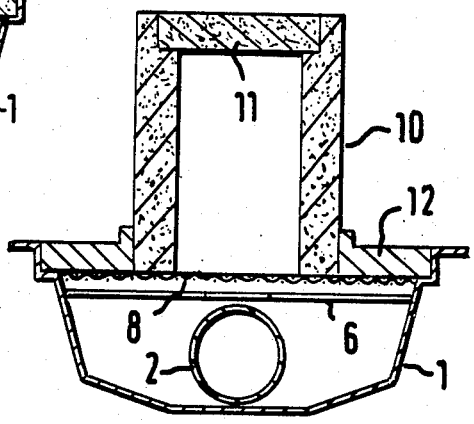

The invention is illustrated by way of example on the accompanying drawing, in which:

FIG. 1 is a plan of a gas burner box base with the radiant burner element omitted, FIG. 2 is a cross-section, on the line II—II of FIG. 1, FIG. 3 is a longitudinal axial section of a complete gas burner assembly, and FIG. 4 is a cross-section, like FIG. 2, showing another form of radiant burner element.

The gas burner assembly illustrated by FIGS. 1 to 3 has a base comprising a metal tray box 1, forming a mixing chamber, having inserted through one end an air inlet tube 2 with a venturi mouth 3 into which is directed a gas injector jet 4 carried by an open-bottom, air-inlet, bracket 5 on the end of the box 1. In FIG. 1 the top of the bracket 5 is broken away to show the jet 4 and venturi mouth 3. The tube 2 extends more than half way along the box 1 and opens beneath a distributor plate 6 which baffles direct upward flow of gas/air mixture induced through the tube 2 by the gas jet entraining atmospheric air through the open bottom of the bracket 5.

The radiant burner element surmounting the mixing chamber is simply a plaque 7 of ceramic foam material which closes the top of the box 1. Closely below the plaque 7 there is provided a sheet of metal gauze 8 as a flame trap to prevent burning back into the box 1.

The arrangement of the box 1, plaque 7 and tube 2 opening below the plate 6 ensures circulation of the gas/air mixture in the mixing chamber before it can pass through the pores of the plaque 7 to emerge and burn at the radiant surface 9 thereof which may be ribbed or otherwise contoured to increase its radiant area. A plane surface or simulated fuel effect could be used.

In the embodiment shown by FIG. 4, the radiant burner element surmounting the mixing chamber 1 is a cylindrical tube 10 of ceramic foam material, closed at the top by a cap 11 of the same material, the tube 10 being seated in a mounting plate 12, of metal or solid ceramic material, and guarded beneath by a metal gauze flame trap 8.

It will of course be understood that the burner assembly may be used with the radiant burner element facing horizontally, or otherwise as required, the box base 1 not necessarily being lowermost.

The dimensions and proportions of the assembly components are designed to suit requirements and the porosity and thickness of the ceramic foam material of the radiant burner element and size of the gas jet 4 are selected to suit a given gas and supply pressure, from mains or a bottle, within the ranges set out above.

To provide a radiant burner element with a simulated fuel appearance, part of the element face can be sealed with a refractory glaze, or other refractory material, coloured or uncoloured, and shaped to resemble solid fuel. Obviously, for any given element, this reduces the available pore passage for gas/air mixture to burn at the element face and the design or adjustment of the burner assembly should be varied to obtain stable combustion.

Examples of burners in accordance with the invention, all for radiant burner elements in the form of rectangular plaques of a plan size 178 mm×127 mm, are given in the following table.

| Gas | Pressure Range Inches Water Gauge | Jet Size Nos. Range | Ceramic Foam Porosity per linear 25 mm | Plaque Thickness mm. |
|---|---|---|---|---|
| Butane | 8–12 | 80–95 | 17–25 | 10 |
| " | 9–13 | 65–90 | 30 | 19 |
| " | 9–12 | 75–90 | 30 | 30 |
| " | 10–12 | 65–75 | 30 | 8 |
| Natural Gas (Methane) | 5.5–8 | 160–220 | 30 | 10 |
| United Kingdom Gas Council Standard Test Gas C | 12–16 | 60–85 | 30 | 10 |

In the above table:

The metric equivalents for the gas pressures given in inches water gauge are:

| Inches | | mm |
|---|---|---|
| 5.5 | = | 139.7 |
| 8 | = | 203.2 |
| 9 | = | 228.6 |
| 10 | = | 254.0 |
| 12 | = | 304.8 |
| 13 | = | 330.2 |
| 16 | = | 406.4 |

The jet size numbers given are for "Bray Gas Injectors", supplied by George Bray & Co. of Leeds, England, and the numbers are related to bore diameter, the higher the number the larger the bore, although they are not a direct measure of the bore. With such small bores, which users could not measure accurately, it is necessary to utilise standards set by the jet manufacturer.

In the examples given above, the Bray jet numbers given have the following approximate bore diameters:

| | | | |
|---|---|---|---|
| No. | 65 = 0.72 mm | No. | 90 = 0.85 mm |
| | 75 = 0.78 mm | | 95 = 0.87 mm |
| | 80 = 0.79 mm | | 160 = 1.12 mm |
| | 85 = 0.82 mm | | 220 = 1.31 mm |

All the above examples gave stable combustion, without burning back, and with acceptable noise level for radiant outputs between 300 and 500 BTU (British Thermal Units) measured, in a known manner, with a pyrometer thermopile at a distance of 40 cm. These radiant outputs are comparable with the outputs of conventional solid plate self-aerating burners under similar test conditions.

The type of ceramic foam material used and its density has not been found to be a critical factor in the performance of the gas burners of the present invention. The ceramic foam material selected should have adequate mechanical and thermal properties to withstand mechanical handling during assembly of the burner and repeated cycling to operating temperature. Cordierite ceramics have been found to be particularly suitable. Similarly, the bulk density of the ceramic foam material is not critical. Materials of low density tend to have less than adequate mechanical strength and those of too high a density tend to have a significant proportion of their porosity 'blinded' by continuous webs of the ceramic material. Cordierite foam material of 30 pores per linear 25 mm porosity and bulk densities in the range 0.13 to 0.25 g/cm$^3$ have been found to work satisfactorily.

I claim:

1. A self-aerating radiant gas burner assembly comprising a box base mixing chamber having an air inlet into which is directed a gas injector jet to induce flow of air through the inlet, the chamber being surmounted by a radiant burner element of ceramic foam material, the bore diameter of the gas injector jet being between 0.5 and 2.0 mm inclusive, the nominal porosity of the ceramic foam material being between 15 and 40 pores per linear 25 mm inclusive, the thickness of the burner foam material being between 8 and 30 mm inclusive and the dimensions within these ranges being selected for a specified gas and pressure range with the relationship that the lower the gas pressure the larger the jet size.

2. A self-aerating radiant gas burner assembly according to claim 1, in which the nominal porosity of the ceramic foam material is about 30 pores per linear 25 mm.

3. A self-aerating radiant gas burner assembly according to claim 1, in which the mixing chamber comprises a tray box of which the top is closed by the radiant burner element of ceramic foam material, with a flame trap below, and the gas injector is carried by an air-inlet bracket and is directed into the throat of a venturi tube which extends axially along the tray box and terminates with an open end beneath a distributor plate which baffles direct flow of gas/air mixture to the radiant burner element.

4. A self-aerating radiant gas burner assembly according to claim 2, in which the mixing chamber comprises a tray box of which the top is closed by the radiant burner element of ceramic foam material, with a flame trap below, and the gas injector is carried by an air-inlet bracket and is directed into the throat of a venturi tube which extends axially along the tray box and terminates with an open end beneath a distributor plate which baffles direct flow of gas/air mixture to the radiant burner element.

* * * * *